US008991630B2

(12) United States Patent
Wang

(10) Patent No.: US 8,991,630 B2
(45) Date of Patent: Mar. 31, 2015

(54) COMBINATION STRUCTURE OF FRAME MEMBER AND VIEWING COVER FOR FOOD CONTAINER COVER

(75) Inventor: Soo chang Wang, Seoul (KR)

(73) Assignee: Korea Alphaline Co. Ltd., Kangdong-Ku, Seoul (KR)

( * ) Notice: Subject to any disclaimer, the term of this patent is extended or adjusted under 35 U.S.C. 154(b) by 0 days.

(21) Appl. No.: 14/003,244

(22) PCT Filed: Feb. 24, 2012

(86) PCT No.: PCT/KR2012/001421

§ 371 (c)(1),
(2), (4) Date: Jan. 27, 2014

(87) PCT Pub. No.: WO2012/121500

PCT Pub. Date: Sep. 13, 2012

(65) Prior Publication Data

US 2014/0217101 A1 Aug. 7, 2014

(30) Foreign Application Priority Data

Mar. 9, 2011 (KR) ..... 20-2011-0001934 U

(51) Int. Cl.
*B65D 45/00* (2006.01)
*B65D 43/02* (2006.01)
*B65D 45/30* (2006.01)

(52) U.S. Cl.
CPC ..... *B65D 45/00* (2013.01); *B65D 43/0208* (2013.01); *B65D 45/30* (2013.01); *B65D 2543/00175* (2013.01); *B65D 2543/00194* (2013.01); *B65D 2543/00231* (2013.01); *B65D 2543/0024* (2013.01); *B65D 2543/00296* (2013.01); *B65D 2543/00351* (2013.01);

(Continued)

(58) Field of Classification Search
CPC ..... B65D 41/00; B65D 51/18; B65D 45/00; B65D 13/02
USPC ..... 220/256.1, 319, 320, 321, 326, 324
See application file for complete search history.

(56) References Cited

U.S. PATENT DOCUMENTS

2003/0116572 A1* 6/2003 Klock et al. ..... 220/367.1
2004/0094548 A1* 5/2004 Laveault ..... 220/212

(Continued)

FOREIGN PATENT DOCUMENTS

KR 10-2005-0006666 A 1/2005

OTHER PUBLICATIONS

International Search Report for PCT/KR2012/001421 Oct. 8, 2012.

*Primary Examiner* — Steven A Reynolds
*Assistant Examiner* — King M Chu
(74) *Attorney, Agent, or Firm* — Donald J. Ranft; Kristen A. Mogavero; Collen IP

(57) ABSTRACT

The invention relates to a combination structure of a viewing cover and a frame member for a food container cover. The combination structure includes: a viewing cover having a combining slot, which has a uniform depth and extends along a periphery of a surface of a viewing cover body, and an engaging flange extending outward at a position above the combining slot; and a frame member including a plurality of locking wings connected to a frame member body via a living hinge, a wall portion extending upward from the living hinge by a predetermined height, and an engaging hook provided on an inner surface of the wall portion. The engaging flange is engaged with an upper portion of the engaging hook.

4 Claims, 2 Drawing Sheets

(52) U.S. Cl.
CPC ..... *B65D2543/00555* (2013.01); *B65D 2543/00592* (2013.01); *B65D 2543/00601* (2013.01); *B65D 2543/00611* (2013.01); *B65D 2543/00629* (2013.01); *B65D 2543/00694* (2013.01); *B65D 2543/00712* (2013.01); *B65D 2543/00805* (2013.01); *B65D 2543/00842* (2013.01)
USPC ..... 220/256.1

(56) References Cited

U.S. PATENT DOCUMENTS

| | | | | |
|---|---|---|---|---|
| 2005/0006390 | A1* | 1/2005 | Wang | 220/326 |
| 2006/0261067 | A1* | 11/2006 | Letica | 220/254.7 |
| 2009/0114650 | A1* | 5/2009 | Houston, Jr. et al. | 220/256.1 |
| 2013/0068767 | A1* | 3/2013 | Fraser et al. | 220/259.3 |

* cited by examiner

COMBINATION STRUCTURE OF FRAME MEMBER AND VIEWING COVER FOR FOOD CONTAINER COVER

TECHNICAL FIELD

The present invention relates to a combination structure of a frame member and a viewing cover for a food container cover and, more particularly, to a combination structure of a frame member and a viewing cover for a food container cover that is provided at an opening of a food container, which can store various kinds of food, so as to open and close the opening of the food container, in which the frame member, having a plurality of locking wings connected to a frame member body via a living hinge, can be securely fixed to the circumference of the viewing cover in a simple way.

BACKGROUND ART

A general food container cover includes front, back, and side locking wings with respective living hinges. As to such a cover, the locking wings are engaged with protrusions on the outer surface of the body of a food container so that the cover is fixed to the body of the food container. There is a different type of food container cover. This type includes a viewing cover and a frame member with locking wings. This cover is fixed to the body of a food container in a manner that the viewing cover is first combined with the frame member having the locking wings, and then the locking wings are engaged with protrusions formed on the outer surface of the body of the food container.

The cover having the structure in which the cover body and the locking wings are integrally formed is formed of a flexible synthetic resin. The cover having the structure in which the frame member and the viewing cover are separately provided and combined for use has advantages: the viewing cover formed of a transparent material allows the user to view the inside of a food container without opening a cover; and the viewing cover and the frame member are allowed to differ in color so that the cover may have two colors, which may impart the cover with an attractive appearance.

On the other hand, "an air tight container comprising double covers" which was applied for a utility model by the present applicant of this application and is now registered as a utility model under a utility model registration number of 033117, includes a typical container body and a special cover that closes the container body. In the technology, either the container body or the cover is provided with locking wings, and the other is provided with fixing protrusions to be engaged with the locking wings. The cover includes: a flexible coupling cover including a frame-shaped body, an accommodating portion which is the same in shape to the opening of the container body and accommodates the edge of the opening of the container body therein when the cover closes the opening of the container body, and an opening at the center thereof; and a viewing cover including a plate-like lid arranged at the position of the opening of the viewing cover, and a combining unit which extends outward from the edge of the lid, curves downward, is to be accommodated in the accommodating portion of the coupling cover, and has a plurality of combining protrusions protruding upward from the top surface thereof at predetermined intervals. The coupling cover has a plurality of combining holes in the accommodating portion at the positions corresponding to the combining protrusions so that the combining protrusions of the combining unit pass through the accommodating portion and are inserted into the combining holes. The combining unit has a channel-shaped combining slot open at the bottom of the combining unit so that the edge of the opening of the container body can be fitted into the slot. The combining unit with the combining slot of the viewing cover is received in the accommodating portion of the coupling cover so that the viewing cover and the coupling cover are combined.

However, the cover of the airtight container with double covers brings the disadvantages that it is difficult to manufacture the cover due to its complicated structure, and a frame member is highly likely to be separated from the viewing cover by even a very weak physical force because the combining unit of the viewing cover is inserted in the accommodating portion of the coupling cover.

DISCLOSURE OF INVENTION

Technical Problem

Accordingly, the present invention has been made keeping in mind the above problems occurring in the related art, and is intended to provide a combination structure of a frame member and a viewing cover for a food container cover which has a simple structure so as to be manufactured and assembled with ease and which is capable of preventing the frame member from being easily separated from the viewing cover, thereby having high reliability.

Solution to Problem

In an aspect, the present invention provides a combination structure of a frame member and a viewing cover for a food container cover, including: the viewing cover having a combining slot, which has a uniform depth and extends along a periphery of a surface of a viewing cover body, and an engaging flange extending outward at a position above the combining slot; and the frame member including a plurality of locking wings connected to a frame member body via a living hinge, a wall portion extending upward from the living hinge by a predetermined height, and an engaging hook provided on an inner surface of the wall portion.

In the combination structure of a viewing cover and a frame member for a food container, the engaging hook may include a plurality of engaging hooks arranged at regular intervals along a circumference of the inner surface of the wall portion.

The combination structure of a viewing cover and a frame member for a food container cover may further include a combining portion extending horizontally from the wall portion and then extending downward from the horizontal extension, in which the combining portion may be engaged with the combining slot.

In the combination structure of a viewing cover and a frame member for a food container cover, the combining portion may include a plurality of combining portions arranged at regular intervals along a circumference of the wall portion.

In another aspect, the invention provides a combination structure of a viewing cover and a frame member for a food container cover, including: the viewing cover having a combining slot, which has a uniform depth and extends along a periphery portion of a surface of a viewing cover body, and a bent portion first horizontally extending outward at a position above the combining slot and then bent downward; and the frame member including a plurality of locking wings connected to a frame member body via a living hinge, a wall portion extending upward from the living hinge by a predetermined height, and a combining portion protruding from an outer surface of the wall portion in a certain direction, and an engaging hook formed at a lower end of the wall portion, in which the combining portion is engaged with the combining slot and a lower end of the bent portion is engaged with the engaging hook.

Advantageous Effects of Invention

As described above, the combination structure of a frame member of a viewing cover for a food container cover according to the present invention has a simple structure so that it can be easily manufactured and assembled. Moreover, in the combination structure, the frame member may not be easily separated from the viewing cover so that the combination structure has high reliability.

MODE FOR THE INVENTION

Hereinbelow, embodiments of the invention will be described in detail with reference to the accompanying drawings.

Figure 1:
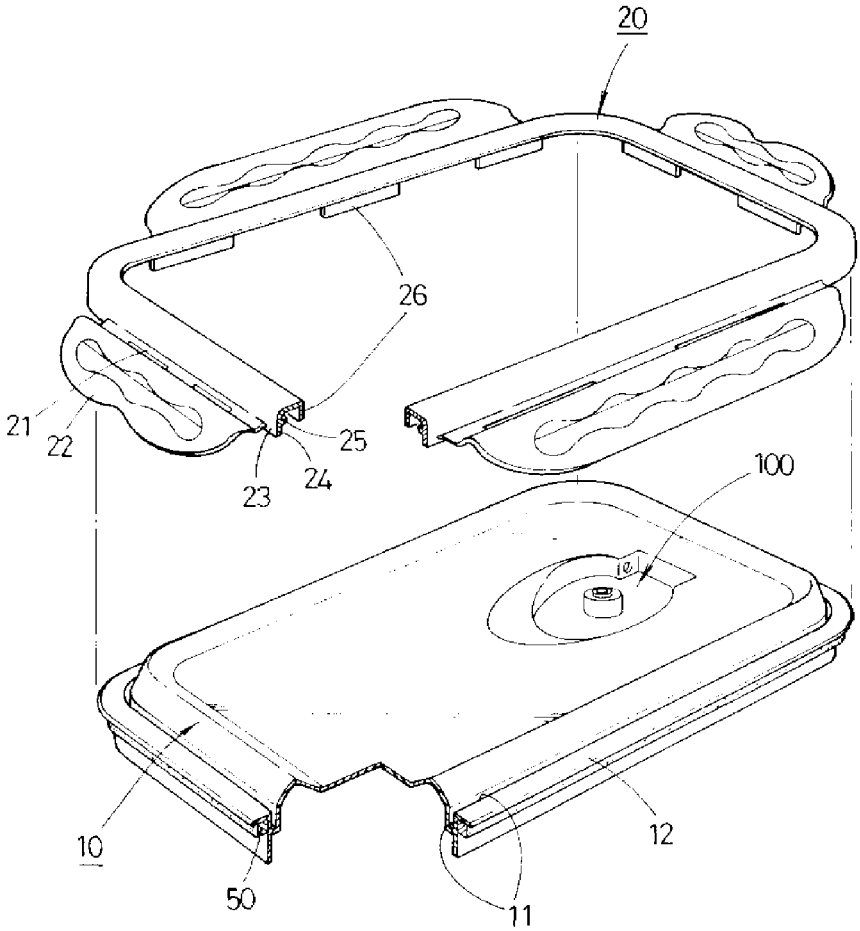
FIG. 1 is an exploded perspective view illustrating a combination structure of a viewing cover and a frame member according to an embodiment.
Figure 2:
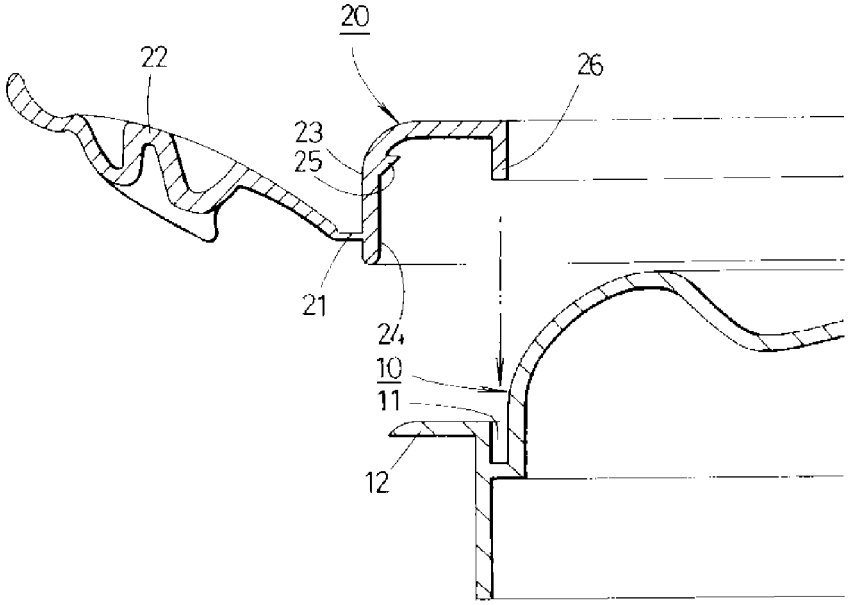
FIG. 2 is an enlarged cross-sectional view illustrating a relevant portion of the viewing cover and the frame member.
Figure 3:
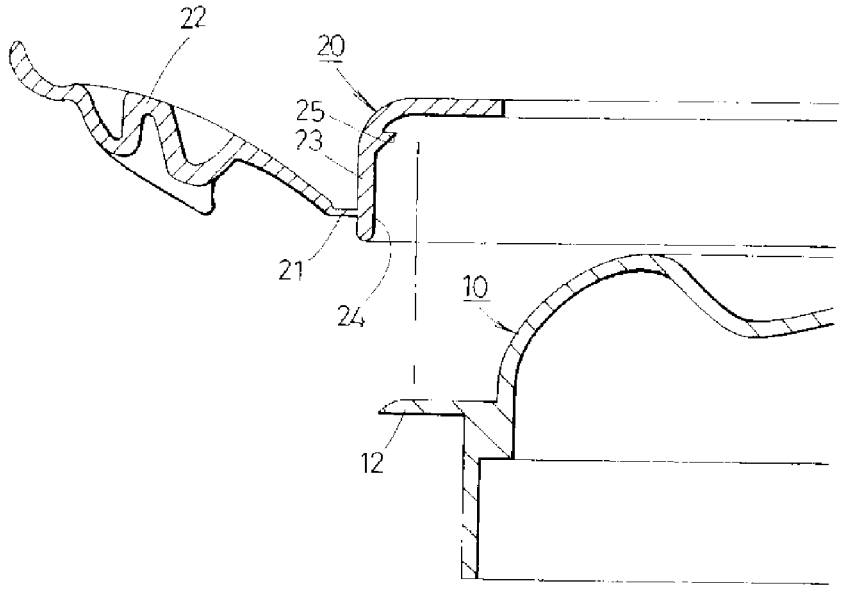
FIG. 3 is an enlarged cross-sectional view illustrating a relevant portion of a combination structure of a viewing cover and a frame member according to another embodiment.
Figure 4:
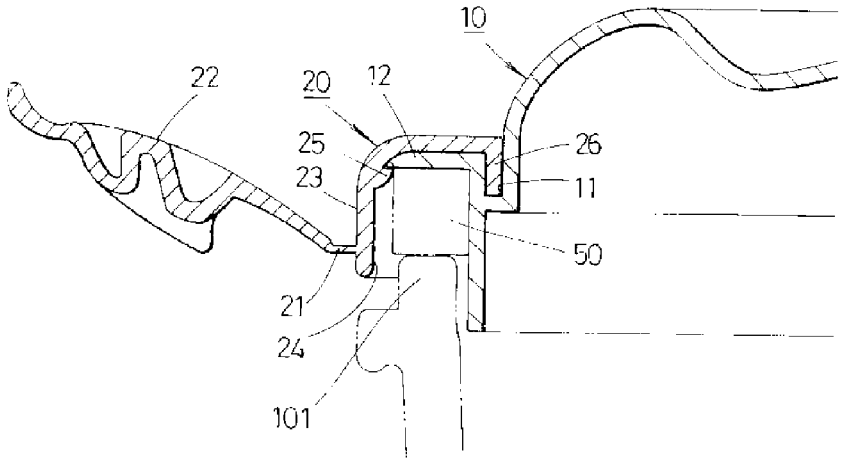
FIG. 4 is a cross-sectional view illustrating a combined state of the viewing cover and the frame member of FIG. 2.

FIG. 1 is an exploded perspective view illustrating a combination structure of a viewing cover and a frame member according to an embodiment, FIG. 2 is an enlarged cross-sectional view illustrating a relevant portion of the viewing cover and the frame member of FIG. 1, and FIG. 4 is a cross-sectional view illustrating a state in which the viewing cover is combined with the frame member.

As illustrated in the figures, the combination structure according to one embodiment of the invention includes a viewing cover 10 formed of a transparent material to allow the user to view the inside of a food container without opening a cover, and a frame member 20 coupled to an upper portion of the viewing cover 10. The frame member 20 and the viewing cover 10 may differ in material and/or color and may be embodied in various forms.

According to the present embodiment of the invention, the viewing cover 10 includes a combining slot 11 having a uniform depth and extending along a periphery of the surface of a viewing cover body, and an engaging flange 12 protruding outward by a predetermined length at a position above the combining slot 11. An outer end of the engaging flange 12 has a curve or a ramp so that it can smoothly slip along an engaging hook 25 to be inserted into an inside space of the engaging hook 25, which facilitates assembly of the components.

The frame member 20 according to the invention includes a plurality of locking wings 22 coupled to a frame member body via a living hinge 21, a wall portion extending upward from the living hinge 21 by a predetermined height, and the engaging hook 25 provided on an inner surface of the wall portion. The engaging hook 25 is made up of a plurality of engaging hooks 25 provided on the inner surface 24 of the wall portion and arranged at regular intervals along the inner circumference of the wall portion. Alternatively, there may be one engaging hook 25 having a closed loop shape formed along the inner circumference of the wall portion.

When assembling the viewing cover 10 and the frame member 20, the engaging flange 12 is pressed to be inserted into a space surrounded by the inner surface 24 of the wall portion. In this case, since the frame member 20 is formed of a synthetic resin, the frame member 20 may be expanded outward, so that the flange 12 can slide along the surface of the engaging hook 25 and then along an end portion of the hook 25, and is finally fitted into a space defined between the engaging hook 25 and the inside surface 24 of the wall portion. As a result, the engaging flange 12 and the engaging hook 25 are engaged with each other.

The frame member 20 further includes a combining portion 26 which first extends horizontally in a direction from the wall portion and then extends downward from the horizontal extension. The combining portion 26 is engaged with the combining slot 11. Thanks to adopting this engagement, the viewing cover 10 and the frame member 20 can be firmly combined as illustrated in FIG. 4. There may be a plurality of the combining portions 26 arranged at predetermined intervals along the outer surface 23 of the wall portion. Alternatively, there may be only one combining portion 26 having a closed loop shape formed along the outer surface 23 of the wall portion.

According to the present invention, the frame member and the viewing cover are assembled as described above. Since the combination structure has a relatively simple structure, the combination structure can be easily manufactured and assembled. Moreover, since the frame member 20 may not be unintentionally separated from the viewing cover 10, the combination structure has high reliability.

Figure 5:
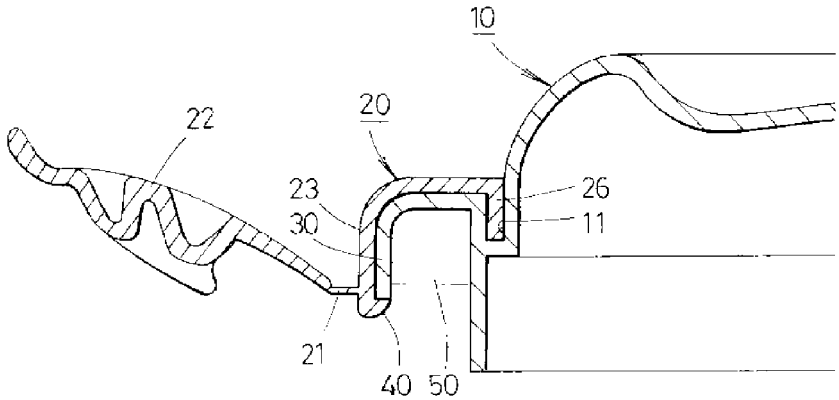
FIG. 5 is a cross-sectional view illustrating a combination structure of a viewing cover and a frame member according to a further embodiment.

FIG. 5 is a cross-sectional view illustrating a combination structure of a viewing cover and a frame member for a food container cover according to another embodiment.

As illustrated in FIG. 5, a viewing cover 10 according to this embodiment includes a combining slot 11 having a uniform depth and running along a periphery portion of the surface of a viewing cover body, an extension protruding outward from the side of the body at a location above the top of the combining slot 11, a bent portion 30 having a first part extending outward from the viewing cover body at a position above the combining slot 11, and a second part extending downward by a predetermined length from a distal end of the first part. In addition, a frame member 20 includes a plurality of locking wings 22 connected to a frame member body via a living hinge, a wall portion 23 extending upward from the living hinge 21 by a predetermined height and thereafter extending in a horizontal direction, a combining portion 26 extending downward from the end of the outer wall portion 23, and an engaging hook 40 provided at a lower end portion of the outer wall portion 23. With regard to this structure, when the components of this structure are assembled, the combining portion 26 may be engaged with the combining slot 11 and the bent portion 30 may be engaged with the engaging hook 40 provided at the lower end of the outer wall portion 23.

Throughout the drawings, reference symbol 50 which has not been described above represents a packing member, reference symbol 100 represents a unidirectional valve which generates a weak vacuum state inside a food container, and reference symbol 101 represents a wall of the food container.

The invention described above has advantages such that: the combination structure of the invention has a simple structure so that it can be easily manufactured and assembled; and the frame member is not unintentionally separated from the viewing cover so that the combination structure of the invention has high reliability.

The terms used in the specification and claims of the invention may not be intended to refer exclusively to dictionary definitions but may be intended to refer to meanings and concepts in accordance with the technical spirit of the invention on the ground that an inventor can act as his or her own lexicographer in order to explain his or her invention in the best way.

The embodiments described in the specification and drawings are only examples of the invention but do not represent the entire technical spirit of the invention, and are not to be construed to limit the invention. Accordingly, those skilled in the art will appreciate that various modifications and equivalents may be possible without departing from the scope and spirit of the invention at the time that the present application is filed.

The invention claimed is:

1. The combination structure of a viewing cover and a frame member for a food container cover comprising:

the viewing cover having a combining slot, which has a uniform depth and extends along a periphery of a surface of a viewing cover body, and an engaging flange extending outward at a position above the combining slot; and the frame member including a plurality of locking wings connected to a frame member body via a living hinge, a wall portion extending upward from the living hinge by a predetermined height, and an engaging hook provided on an inner surface of the wall portion; and a combining portion extending horizontally from the wall portion and then extending downward from the horizontal extension, wherein the combining portion is engaged with the combining slot.

2. The combination structure of a viewing cover and a frame member for a food container cover according to claim 1, wherein the engaging hook includes a plurality of engaging hooks arranged at regular intervals along a circumference of the inner surface of the wall portion.

3. The combination structure of a viewing cover and a frame member for a food container cover according to claim 1, wherein the combining portion includes a plurality of combining portions arranged at regular intervals along a circumference of the wall portion.

4. A combination structure of a viewing cover and a frame member for a food container cover, comprising:

the viewing cover having a combining slot, which has a uniform depth and extends along a periphery portion of a surface of a viewing cover body, and a bent portion first horizontally extending outward at a position above the combining slot and then bent downward; and the frame member including a plurality of locking wings connected to a frame member body via a living hinge, a wall portion extending upward from the living hinge by a predetermined height, a combining portion protruding from an outer surface of the wall portion in a certain direction, and an engaging hook formed at a lower end of the wall portion, wherein the combining portion is engaged with the combining slot and a lower end of the bent portion is engaged with the engaging hook.

* * * * *